US006162127A

United States Patent [19]

Ochi

[11] Patent Number: 6,162,127

[45] Date of Patent: Dec. 19, 2000

[54] AMUSEMENT PARK WITH RIDES CONVEYING PARK-GOERS IN THEIR OWN MOTOR VEHICLES

[75] Inventor: Yasushi Ochi, Hiranouemachi, Japan

[73] Assignee: Oriental Sangyo Co., Ltd., Osaka, Japan

[21] Appl. No.: 09/149,030

[22] Filed: Sep. 8, 1998

[51] Int. Cl.[7] ..... A63G 1/00

[52] U.S. Cl. ..... 472/43; 472/13; 472/29

[58] Field of Search ..... 472/13, 29, 30, 472/35, 40, 41, 43, 28, 36; 104/53, 77, 78

[56] References Cited

U.S. PATENT DOCUMENTS

| | | | |
|---|---|---|---|
| 1,652,975 | 12/1927 | Davidson | 472/43 |
| 2,206,172 | 7/1940 | Etes | 472/43 |
| 4,512,257 | 4/1985 | Loisel | 104/53 |
| 5,197,923 | 3/1993 | Barber | 472/13 |
| 5,827,123 | 10/1998 | Reverchon | 472/43 |

*Primary Examiner*—Kien T. Nguyen
*Attorney, Agent, or Firm*—Shinjyu Intellectual Property Firm

[57] ABSTRACT

An amusement park includes a plurality of rides, each ride being provided with car support mechanisms. Each car support mechanism is configured to receive and support an automotive vehicle filled with at least one passenger.

51 Claims, 20 Drawing Sheets

AMUSEMENT PARK WITH RIDES CONVEYING PARK-GOERS IN THEIR OWN MOTOR VEHICLES

BACKGROUND OF THE INVENTION

A. Field of the Invention

The present invention relates to amusement park rides which use passenger vehicles as a means for carrying persons on amusement rides.

B. Description of the Related Art

Traditionally, amusement parks have a variety of rides. In particular, rides such as Ferris wheels and roller coasters typically have carriages or carts permanently mounted on supports in the ride, including seats to accommodate thrill seekers. For instance, on a Ferris wheel, a series of pivoting carriages with seats are mounted about the outer periphery of the Ferris wheel. Thrill seekers are seated in the seats and the Ferris wheel rotates lifting the thrill seekers up to view local scenery and the like. Roller coasters typically have a car mounted on tracks. The car includes several seats and restraining devices, such as seat belts, or harnesses, which restrain the thrill seeker as the car rides on the tracks.

Amusement parks are very popular. One of many problems most people experience while visiting an amusement park is the enormous amount of walking between rides and attractions. Another big problem with amusement parks is that the more popular rides have long lines of people waiting to enjoy the ride. People must stand and wait for extended periods of time, with little in the way of comforts or leisurely pleasures. Standing and waiting detracts from the enjoyment of the amusement park.

SUMMARY OF THE INVENTION

One object of the present invention is to make amusement parks more attractive by providing thrill seekers with a more comfortable way to travel between rides and wait in line for those rides.

Another object of the present invention is to provide the comforts of modern passenger automobiles in amusement park rides.

In accordance with the present invention, an amusement park includes at least one amusement ride. The amusement ride includes a plurality of a car support mechanisms. Each of the car support mechanisms is configured to receive and support an automotive vehicle with passengers inside and the amusement ride is configured to move the plurality of car support mechanisms in accordance with the thrills of the amusement ride.

Preferably, the amusement ride is a roller coaster.

Preferably, the car support mechanism includes a front and a rear gate which secure the automotive vehicle thus preventing movement of the automotive vehicle with respect to the car supporting mechanism.

Preferably, the amusement ride is an adventure theater.

Preferably, the car support mechanism includes a mechanism for restraining movement of the tires of the automotive vehicle.

Preferably, the amusement ride is a saucer tea cup ride.

Preferably, the amusement ride is a swing ride.

Preferably, the amusement ride is a ferris wheel.

Preferably, each of the car support mechanisms includes a platform and front and rear gates supported on the platform. The front and rear gates are configured to secure the automotive vehicle to platform thus preventing movement of the automotive vehicle with respect to the car supporting mechanism. The platform is further provided with a plurality of rollers which may be selectively braked against rolling movement.

Alternatively, the car support mechanism includes a generally flat platform upon which an automobile is positionable. The car support mechanism also includes at least two generally upright sides extending from the platform and at least one inflatable bag that is fixed to at least one of the upright sides. Upon inflation, the inflatable bag is configured to engage and secure the automotive vehicle on the platform.

Preferably, the car supporting mechanism includes a gate mounted to the platform. The gate includes a second inflatable bag.

Preferably, the car support mechanism includes means for supporting the platform on an underside thereof for use on the amusement ride and the amusement ride is configured with tracks for receiving the support means.

Alternatively, the car support mechanism includes means for supporting the platform on an upperside thereof for use on the amusement ride. The amusement ride including means for lifting the platform from an upper side thereof.

Alternatively, the car support mechanism may include a generally flat platform upon which an automobile is positionable and at least one first inflatable bag fixed to the platform. The first inflatable bag is configured to engage and secure the automotive vehicle on the platform by preventing wheels of the automotive vehicle from rotating.

Preferably, a second inflatable bag is fixed to the platform proximate a rearward side of the automotive vehicle and the first inflatable bag is positioned proximate a forward side of the automotive vehicle.

Preferably, the car support mechanism further includes a means for contacting an upper surface of the automotive vehicle for restraining upward movement of the automotive vehicle.

These and other objects, features, aspects and advantages of the present invention will become more fully apparent from the following detailed description of the present invention when taken in conjunction with the accompanying drawings where like reference numerals denote corresponding parts throughout.

DETAILED DESCRIPTION OF THE PREFERRED EMBODIMENTS

Figure 1:
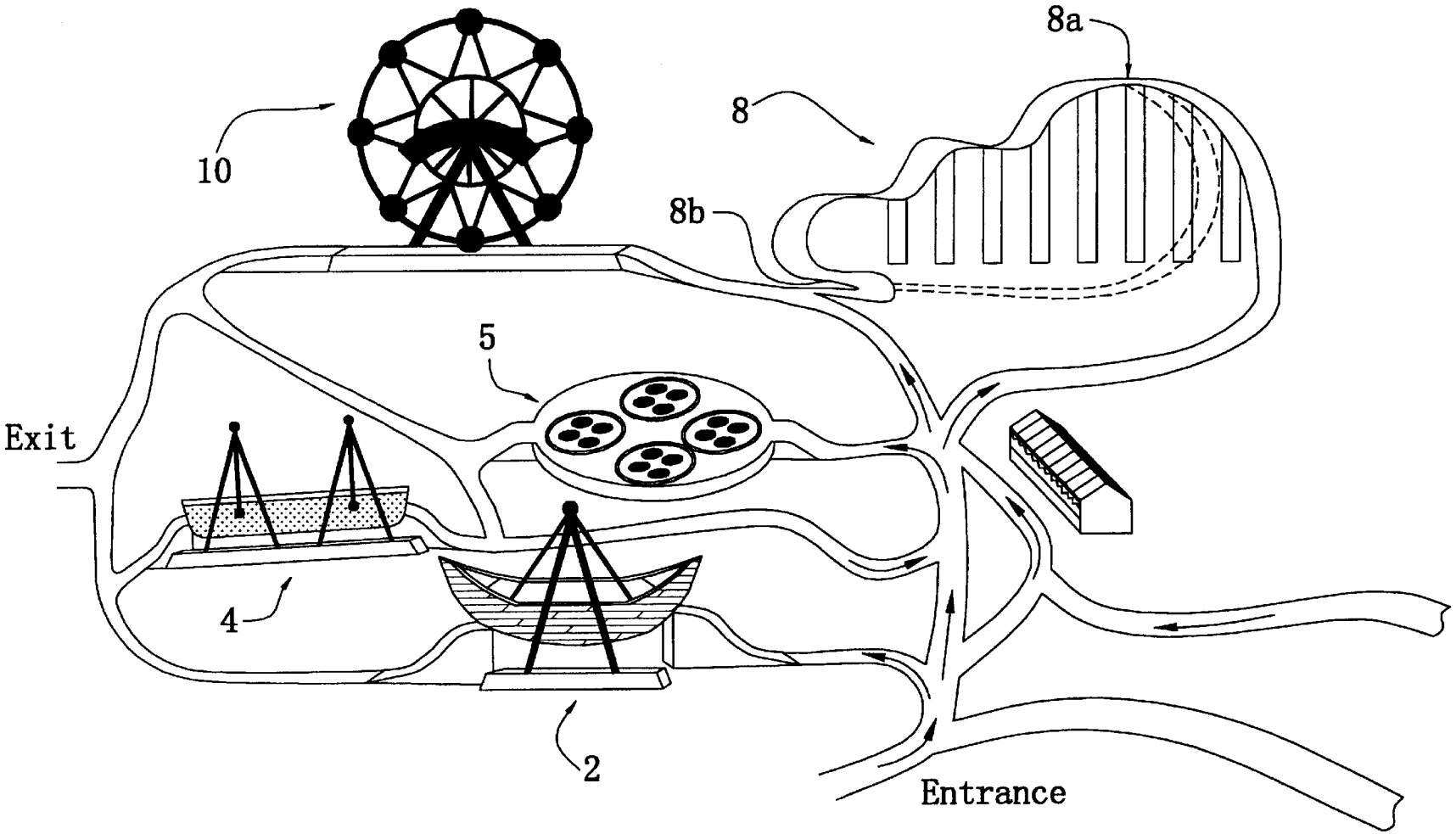
FIG. 1 is a schematic representation of a first section of an amusement park having a variety of rides in accordance with one embodiment of the present invention.
Figure 2:
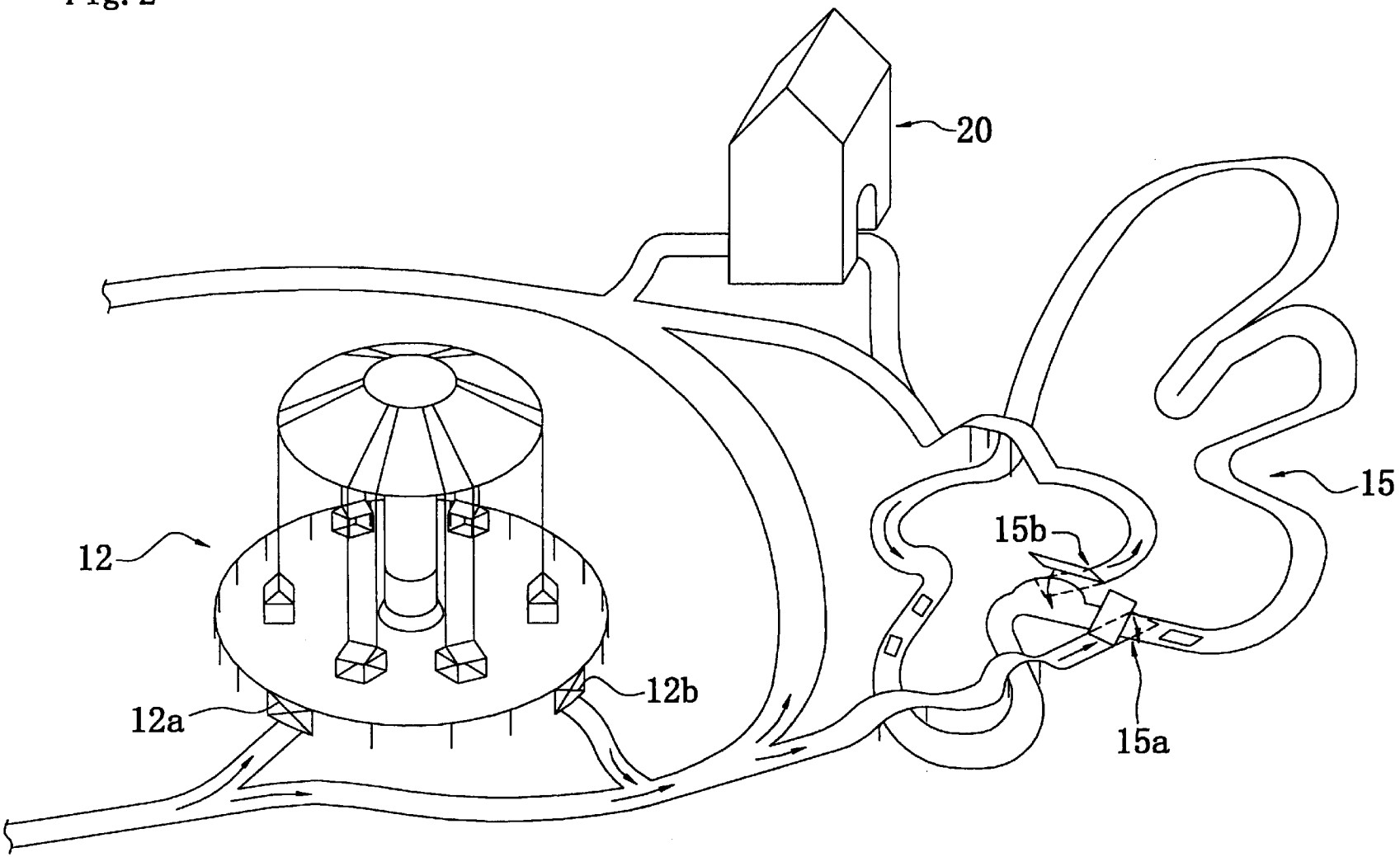
FIG. 2 is a schematic representation of a second section of the amusement park having further rides in accordance with one embodiment of the present invention.

FIG. 1 is a schematic representation of a first section of an amusement park having a variety of rides in accordance with one embodiment of the present invention. The rides include a pirate boat ride 2, a looping boat ride 4, a saucer tea cup ride 5, a roller coaster ride 8 and a Ferris wheel ride. In FIG. 2, a second section of the amusement park is shown having swing ride 12, a water flume ride 15 and an adventure theater 20.

Each of the rides includes an entrance and an exit and corresponding loading and unloading areas. For instance, the roller coaster ride 8 includes a loading zone 8*a* and an unloading zone 8*b*. Likewise, the swing ride 12 has a loading zone 12*a* and an unloading zone 12*b*, and the water flume ride 15 has a loading zone 15*a* and an unloading zone 15*b*.

Figure 3:
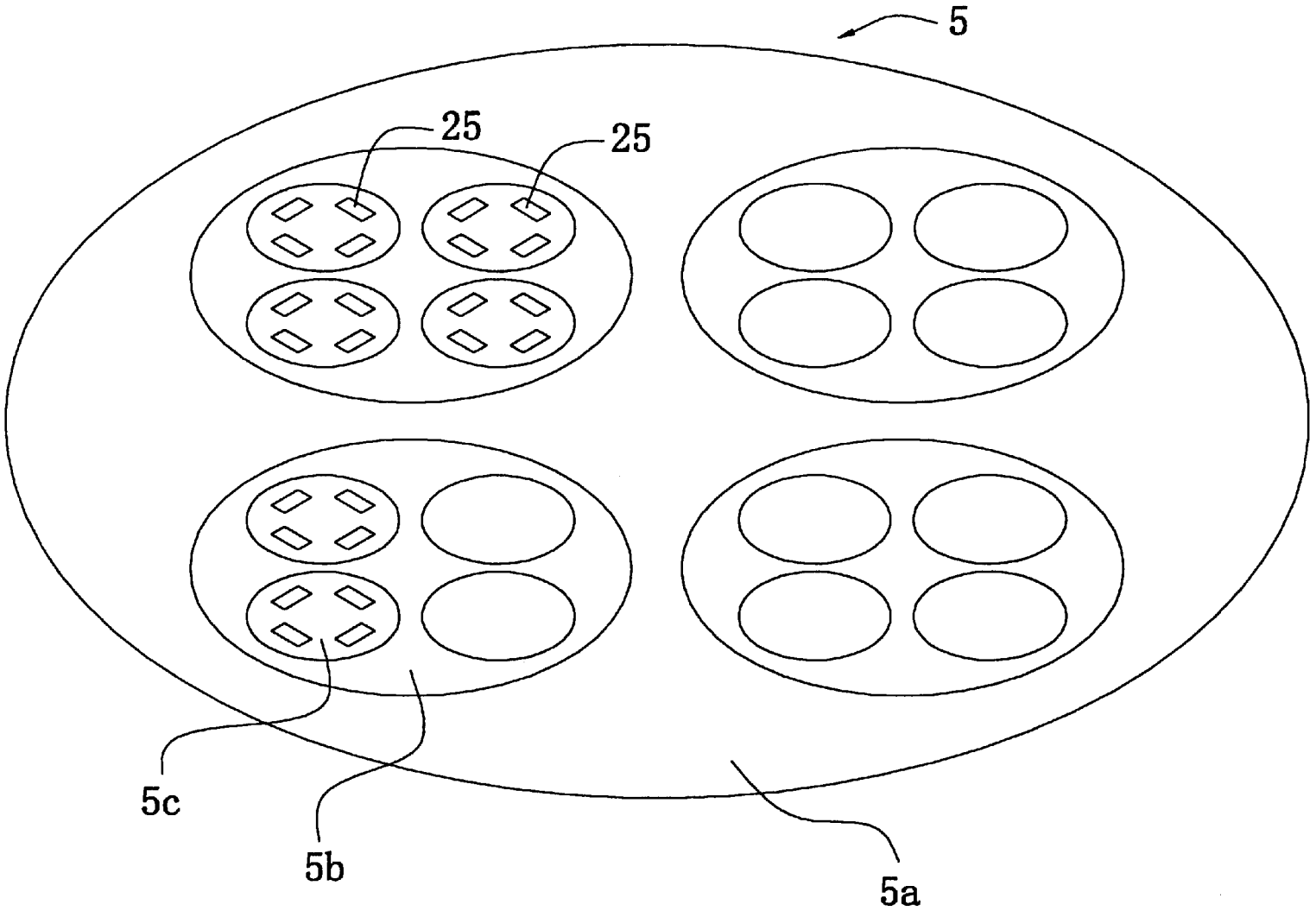
FIG. 3 is a schematic representation of a saucer tea cup ride having car supporting mechanisms.
Figure 5:
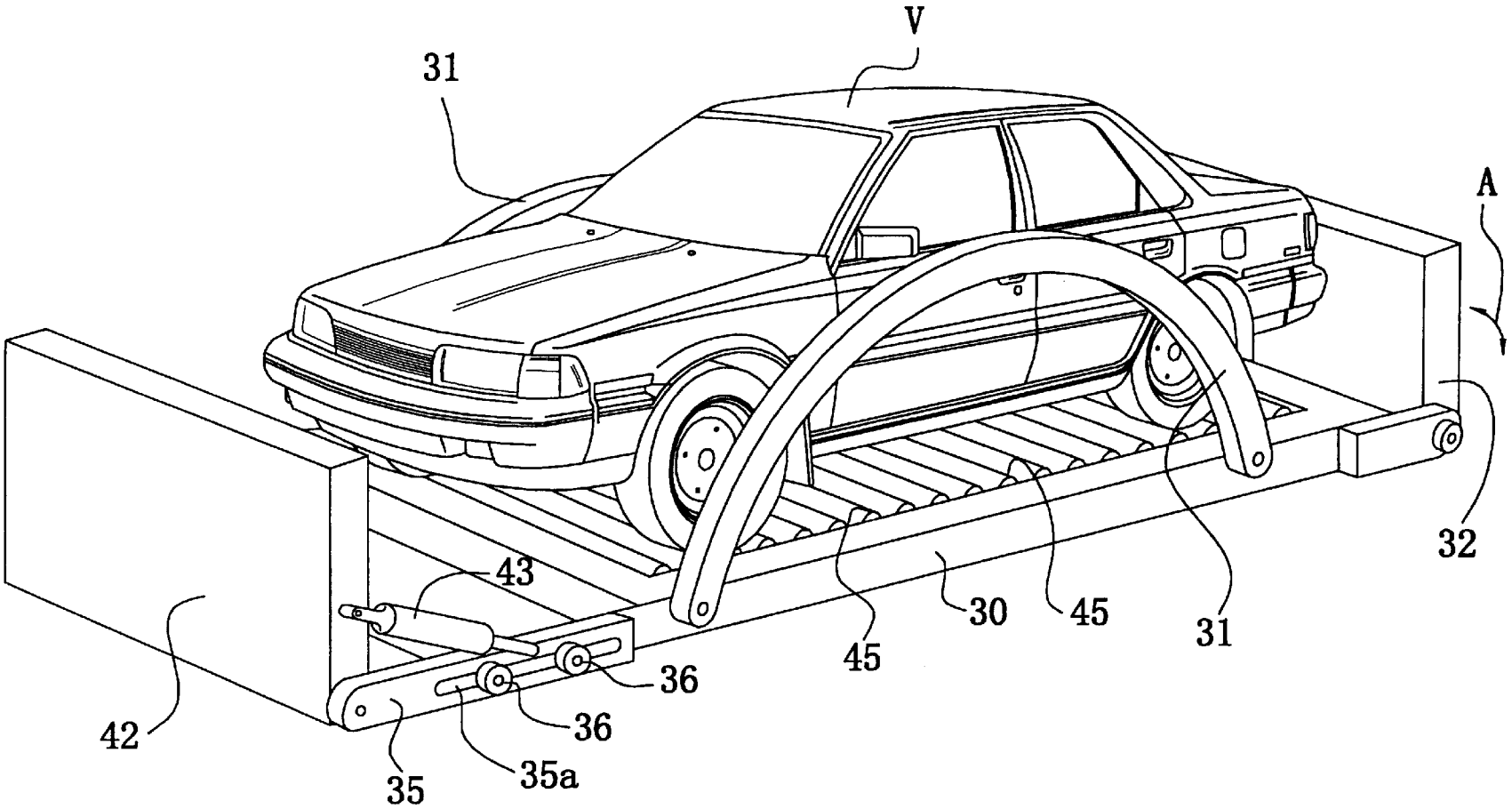
FIG. 5 a car support mechanism used in the rides in the amusement park.

Each of the above mentioned rides is configured to receive and secure automotive vehicles such as the vehicle V shown in FIG. 5. Each ride is therefore provided with a plurality of car supporting mechanisms 25, such as the car supporting mechanisms 25 shown in FIG. 3 on the saucer tea cup ride 5. The saucer tea cup ride 5 includes a large saucer 5*a* which is connected to a large motor (not shown) such that the large saucer 5*a* may be rotated about a central axis thereof. Within the structure of the large saucer 5*a* are four intermediate saucers 5*b* which are each provided with power to rotate about a central axis thereof while the large saucer 5*a* is rotated. Further, each intermediate saucer 5*b* has four small saucers 5*c* which rotate about a central axis thereof while the saucers 5*a* and 5*b* are rotated. Each small saucer 5*c* includes four car supporting mechanisms 25, which are described in greater detail below.

Figure 4:
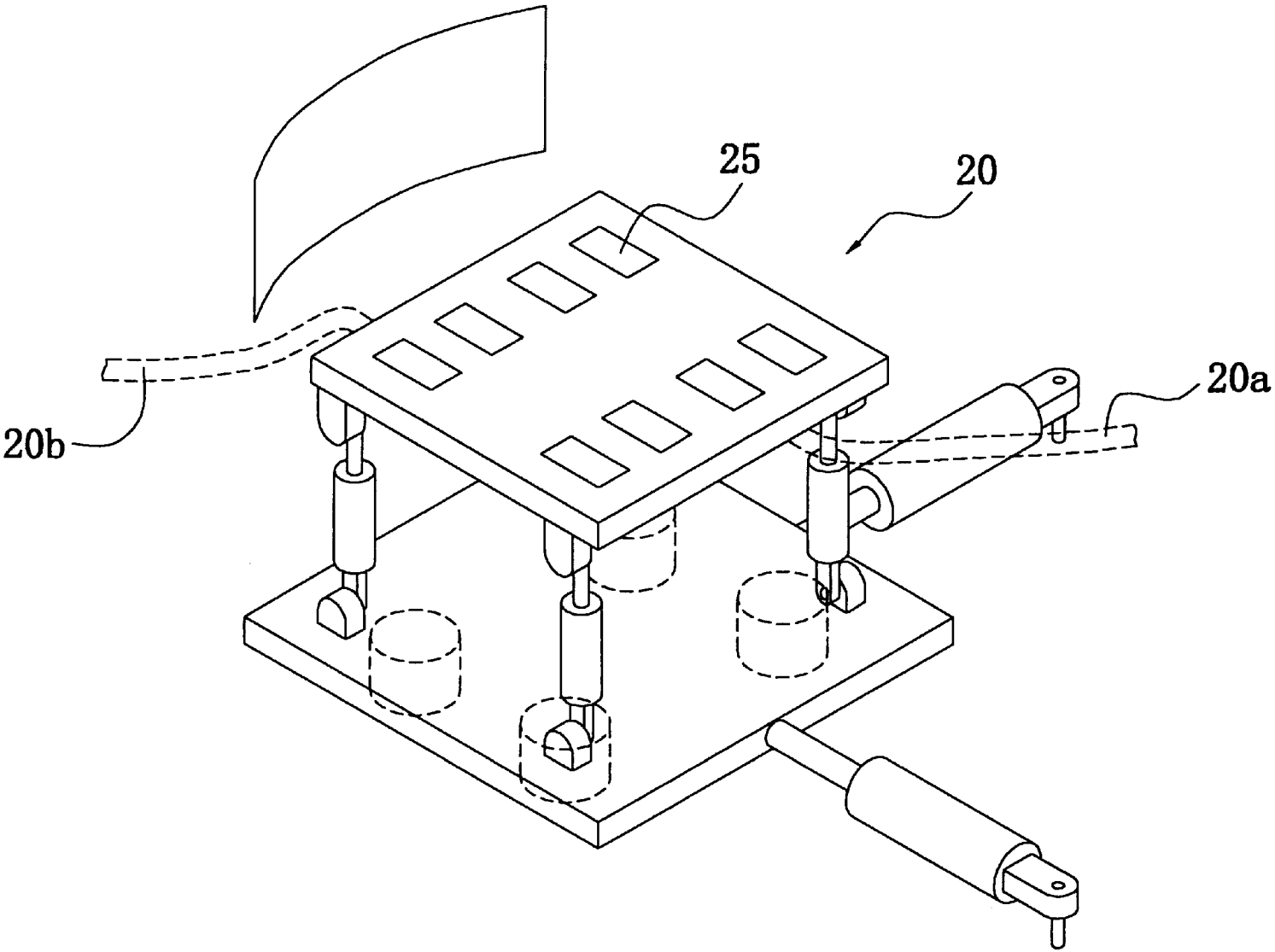
FIG. 4 is an adventure theater having car supporting mechanisms.

In FIG. 4, an adventure theater 20 is depicted. The adventure theater 20 includes a platform supported by a plurality of pressure controlled cylinders such that the platform may be moved in accordance with images projected on a screen. The theater 20 includes an on ramp 20*a* and an off ramp 20*b*. The theater 20 is also provided with a plurality of car supporting mechanisms 25.

FIGS. 5 through 11 depict various types of a car support mechanisms 25 used in the rides in the amusement park. Each ride in the amusement park has its own dynamics, each with different requirements for securing an automotive vehicles safely during the ride.

Figure 6:
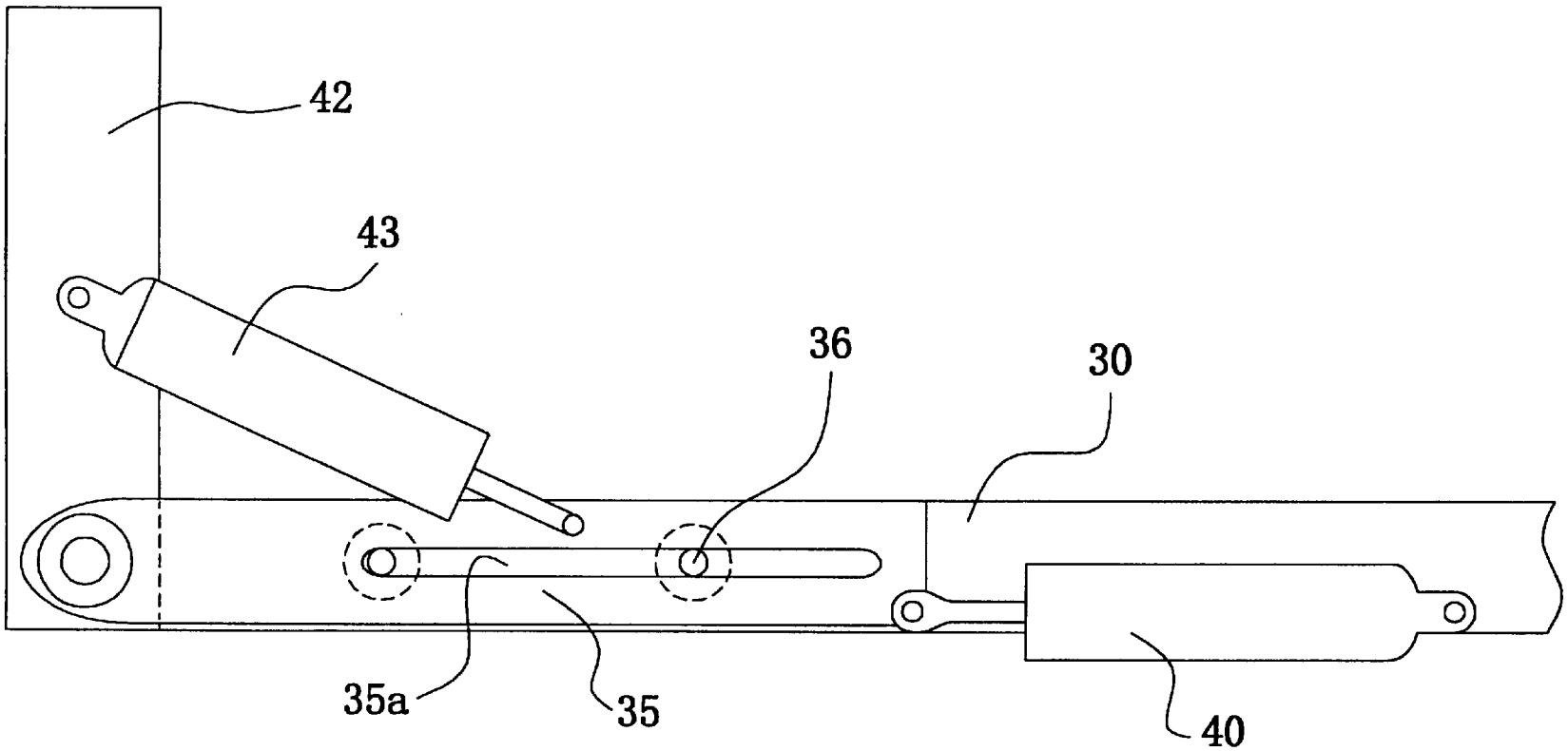
FIG. 6 is a fragmentary side view of the car support mechanism depicted in FIG. 5.

In FIGS. 5 and 6, the car support mechanism includes a platform 30 that includes a support bar 31 which may be made of a strong metal material coated with soft foam material to protect against contact with the car V. A swinging rear gate 32 is moveable up and down as indicated by the Arrow A and powered by a pressure cylinder (not shown).

In the front portion of the platform 30 there are two parallel sliding bars 35 (although only one bar 35 is visible). The sliding bar 35 is secured to the platform 30 but may slide along the pins 36. The sliding movement of the bar 35 is limited by the length of an elongated groove 35*a*. Movement of the bar 35 is controlled by a pressure cylinder 40 that is secured at one end to the platform 30 and secured to the bar 35 at the other end. A front gate 42 is pivotally mounted to the bar 35. Movement of the front gate 42 is controlled by a cylinder 43.

The platform 30 is further provided with a plurality of rollers 45. The rollers 45 are all generally parallel within the platform 30 and are freely rotatable. A braking mechanism (not shown) is mounted within the platform 30 for selectively restricting the rolling movement of the rollers 45.

The car supporting mechanism depicted in FIGS. 5 and 6 operates as follows. When a car is to be loaded on the car supporting mechanism, the rear gate 32 is lowered and the bar 35 is moved to a forward most position. The brake mechanism (not shown) is engaged such that the rollers 45 may not rotate within the platform 30. A car V is then driven onto the platform 30 and the rollers 45. Once the car V is in position, the rear gate 32 is raised and the front gate 42 is moved toward the front of the car V by positioning the sliding bar 35. It should be noted that the front and rear gates 42 and 32 are lined with a soft material such as foam in order to protect the car V from damage in the event of contact therebetween.

Next, the brake mechanism (not shown) is disengaged such that the rollers 45 may rotate freely within the platform 30. In this situation, the car V is secured within the car support mechanism 25 but may not move due to the front and rear gates 42 and 32. Further, in the event that the motor of the car V is running and the driver accidently presses on the accelerator, there is no risk of damage to the car V since the rollers 45 may rotate freely. Since the tires of the car V are engaged with the rollers 45, there is no danger of the car V leaving the car supporting mechanism 25 depicted in FIGS. 5 and 6.

The car support mechanism 25 depicted in FIGS. 5 and 6 is suitable for most of the rides in the amusement park but is particularly suitable for the boat rides 2 and 4 and for the roller coaster ride 8. A car can be driven easily onto the car supporting mechanism 25 and the car supporting mechanism moves in the amusement ride with the passengers of the car V in relative safety.

Figure 7:
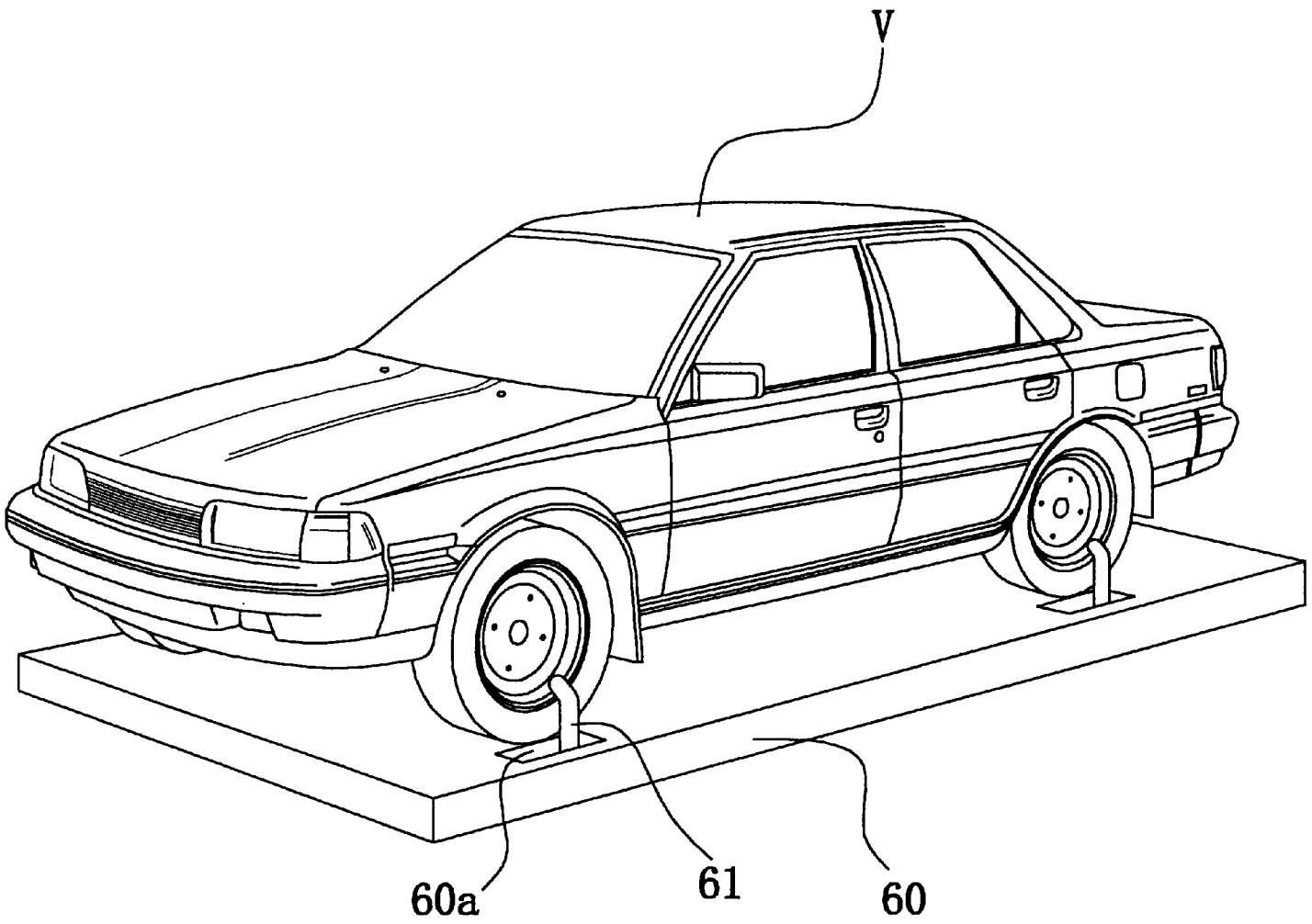
FIG. 7 is another car support mechanism.
Figure 8:
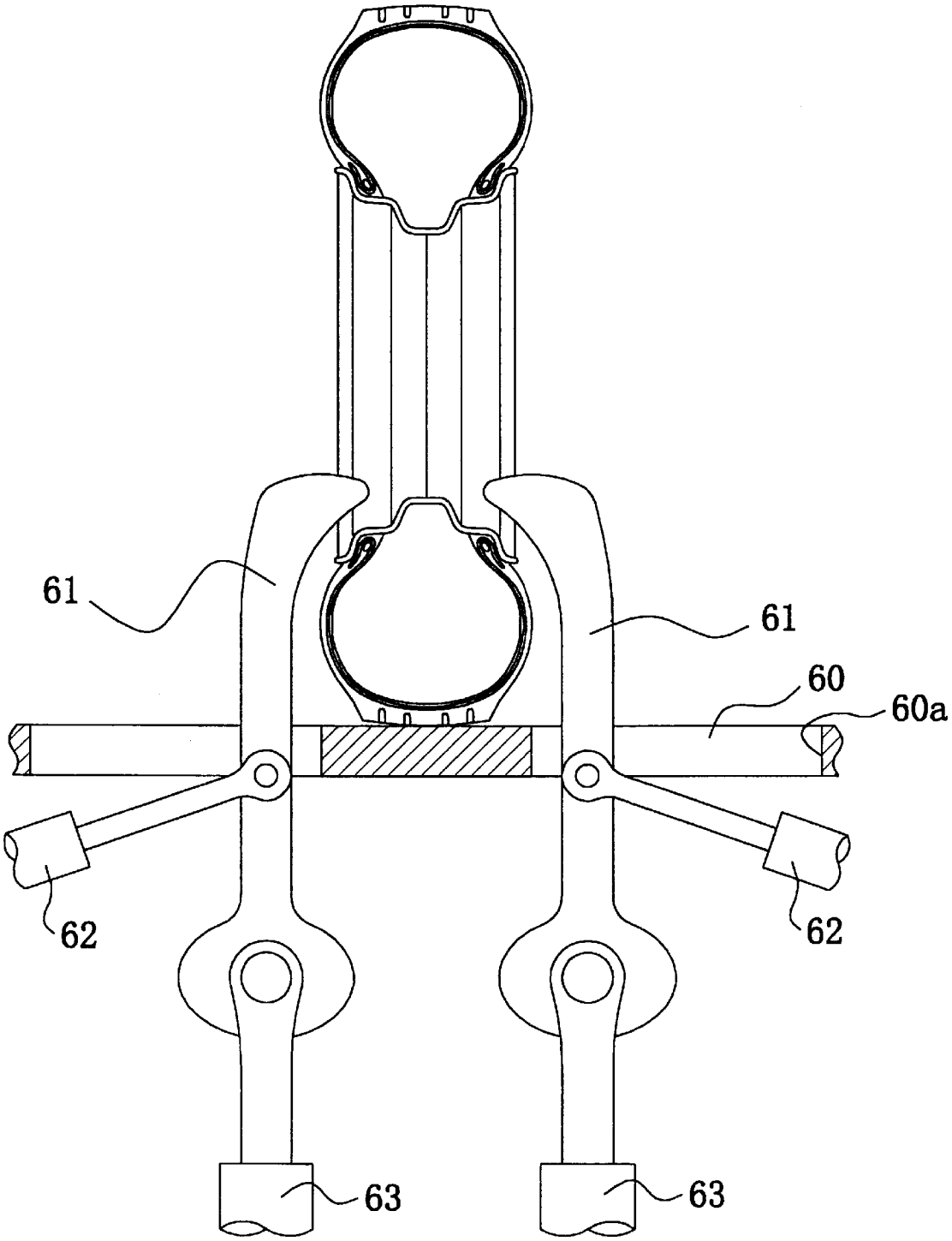
FIG. 8 is a fragmentary side view of the car support mechanism depicted in FIG. 7.

Another car support mechanism is depicted in FIGS. 7 and 8. In this mechanism, a car V is driven onto a platform 60 until the car V is approximately positioned adjacent to openings 60*a*. Once positioned, arms 61 are moved upward on either side of each tire of the car V. Next, the arms 61 can be moved toward one another until engaged with the tire. The movement of the arms 61 is controlled by the cylinders 62 and 63. Once engaged with the tires, the arms 61 securely hold the car V in position on the platform 60. Such a configuration of the car support mechanism may be used on, for instance, the saucer tea cup ride 5.

Figure 9:
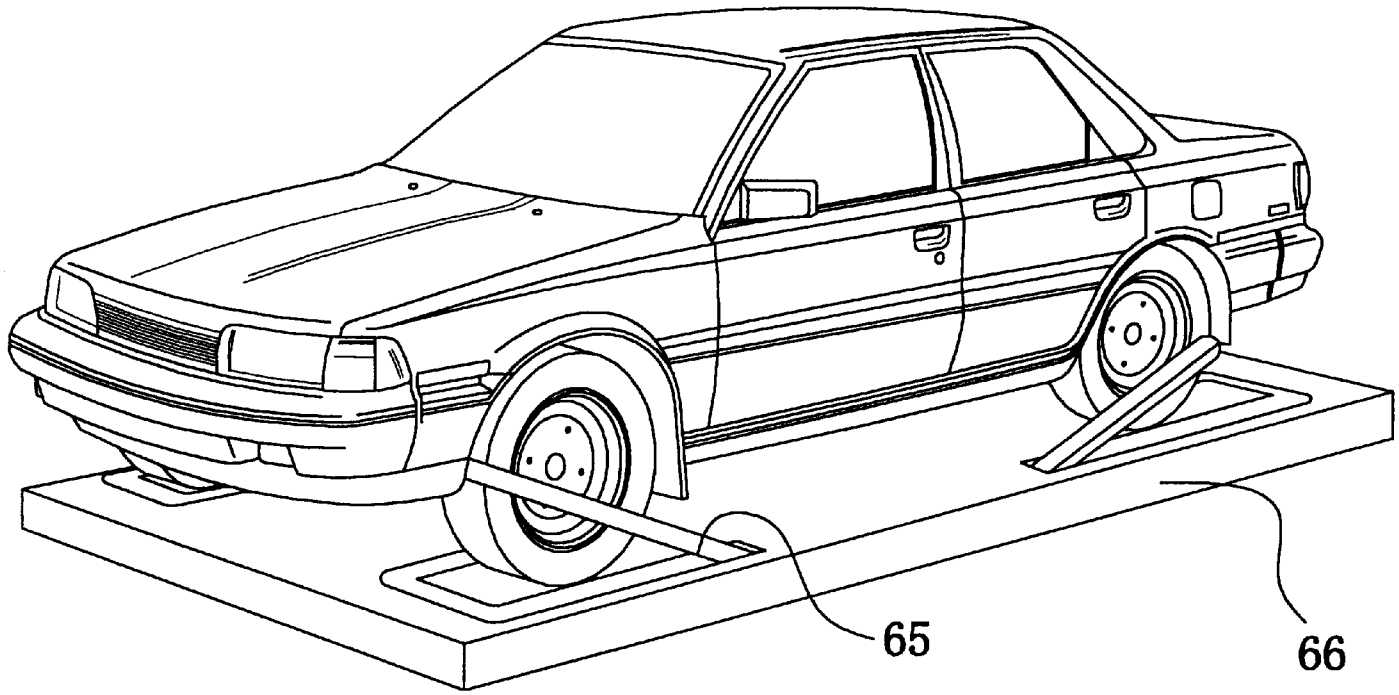
FIG. 9 is another car support mechanism.

A further car support mechanism is depicted in FIG. 9 where an arm 65 is extendable upward out of a platform 66.

Figure 10:
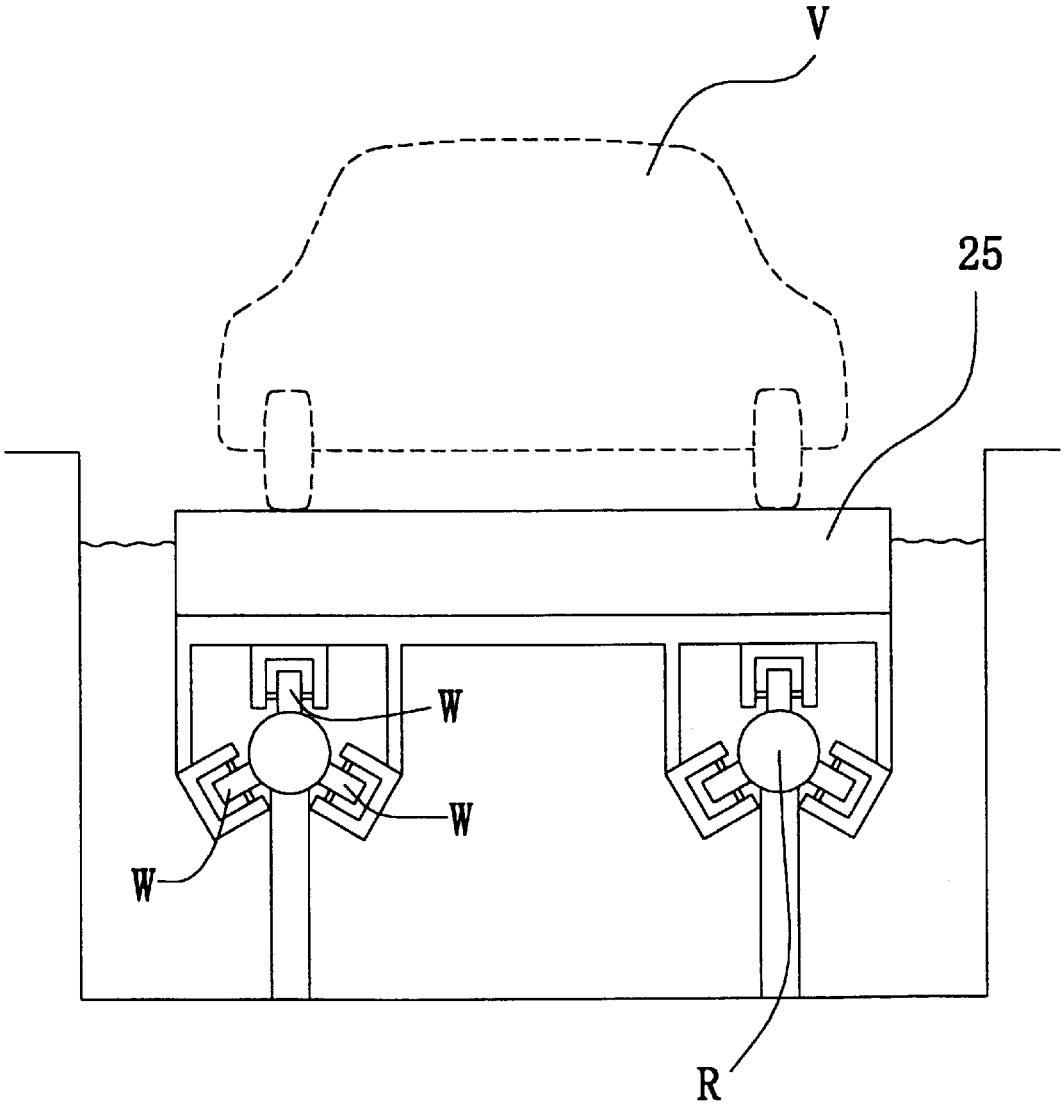
FIG. 10 is another car support mechanism.

The car support mechanisms 25 are supported in the rides in various ways. For instance, in both the roller coaster ride 8 and the water flume ride 15, the car support mechanism 25 is supported on rails R by support structures fixed to a lower portion of the car support mechanism 25, where the support structures include a plurality of wheels which engage the rails R. As shown in FIG. 10, the rails may be submerged under water.

Figure 11:
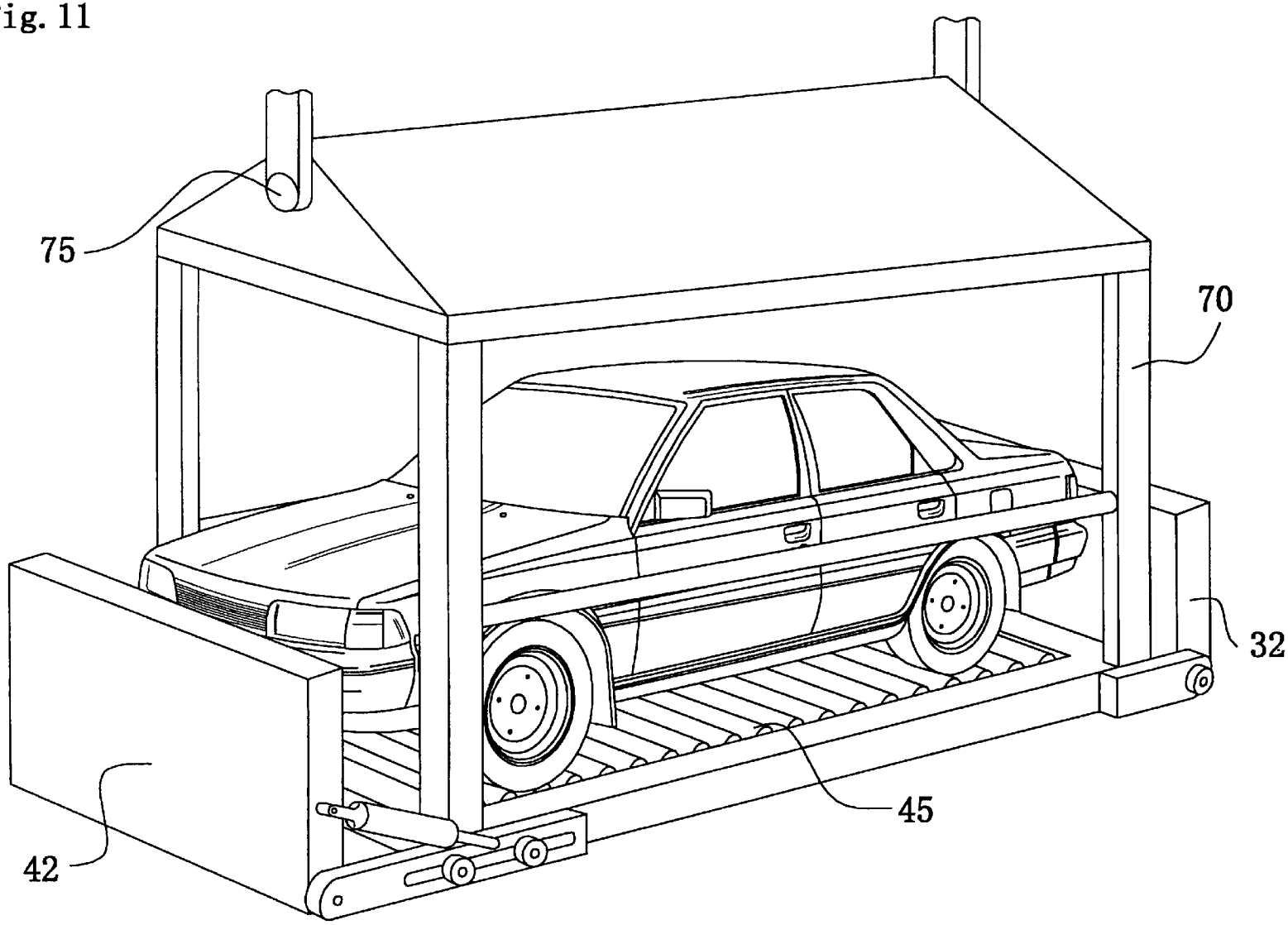
FIG. 11 is yet another support mechanism for use in the amusement park.

Rides such as the Ferris wheel 10 and the swing 12 require a car support mechanism 25 such as that depicted in FIG. 11. The car support mechanism 25 depicted in FIG. 11 includes the rollers 45, the front and rear gates 42 and 32 and a support structures 70 and 75 which allow for the car V to be lifted up. For instance, in the swing ride 12, the cars would be driven onto the platforms of the car support mechanism 25 depicted in FIG. 11, then the central support of the swing ride 12 moves upward, the car support mechanisms are lifted off the ground and swung slowly around. The Ferris wheel 10, on the other hand, lifts the car support mechanisms off the ground as the Ferris wheel rotates.

Figure 12:
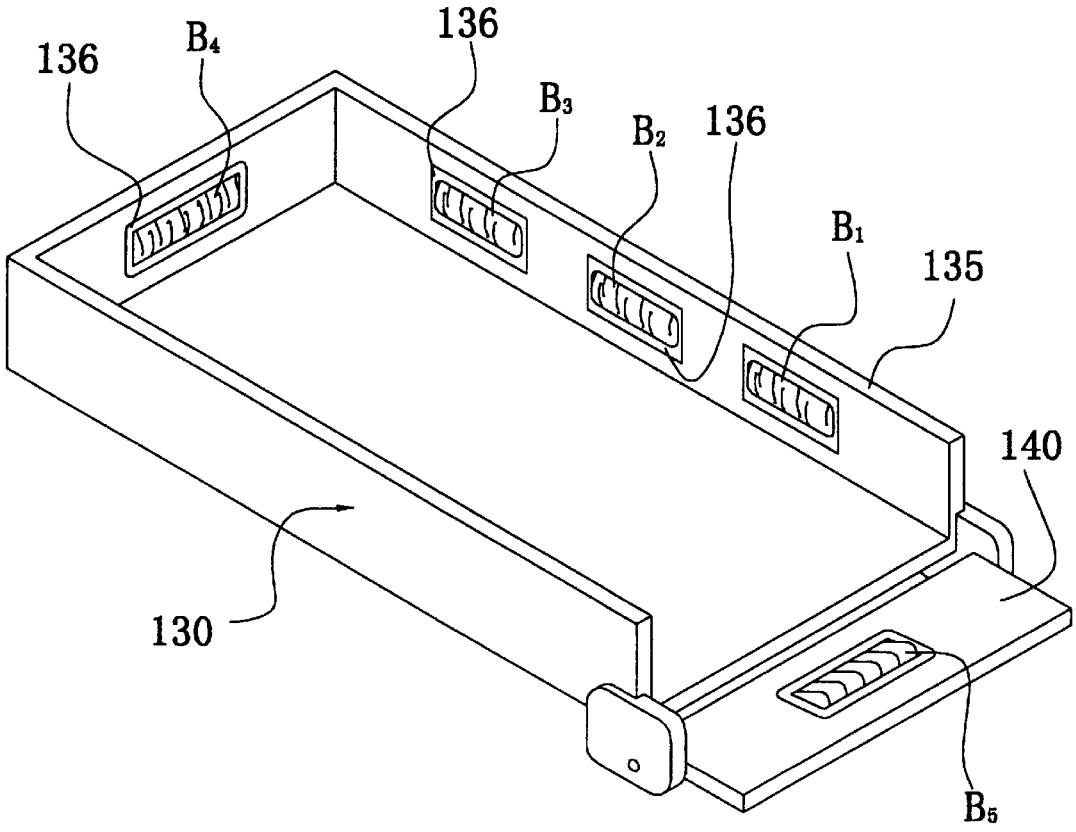
FIG. 12 is a perspective view of yet another support mechanism for use in the amusement park, where the support mechanism includes inflatable support bags.
Figure 13:
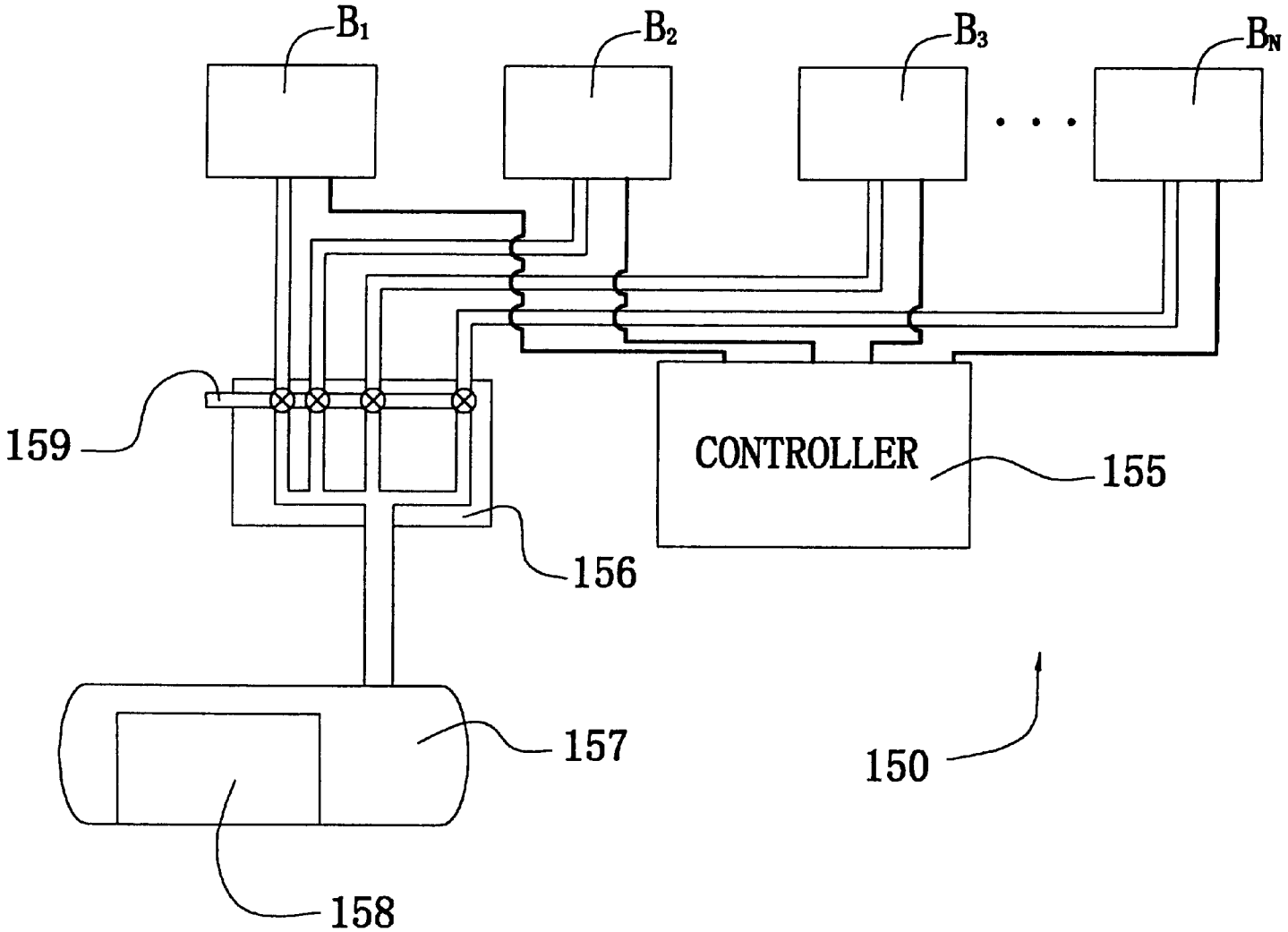
FIG. 13 is a control system for controlling the inflatable support bags depicted in FIG. 12.
Figure 14:
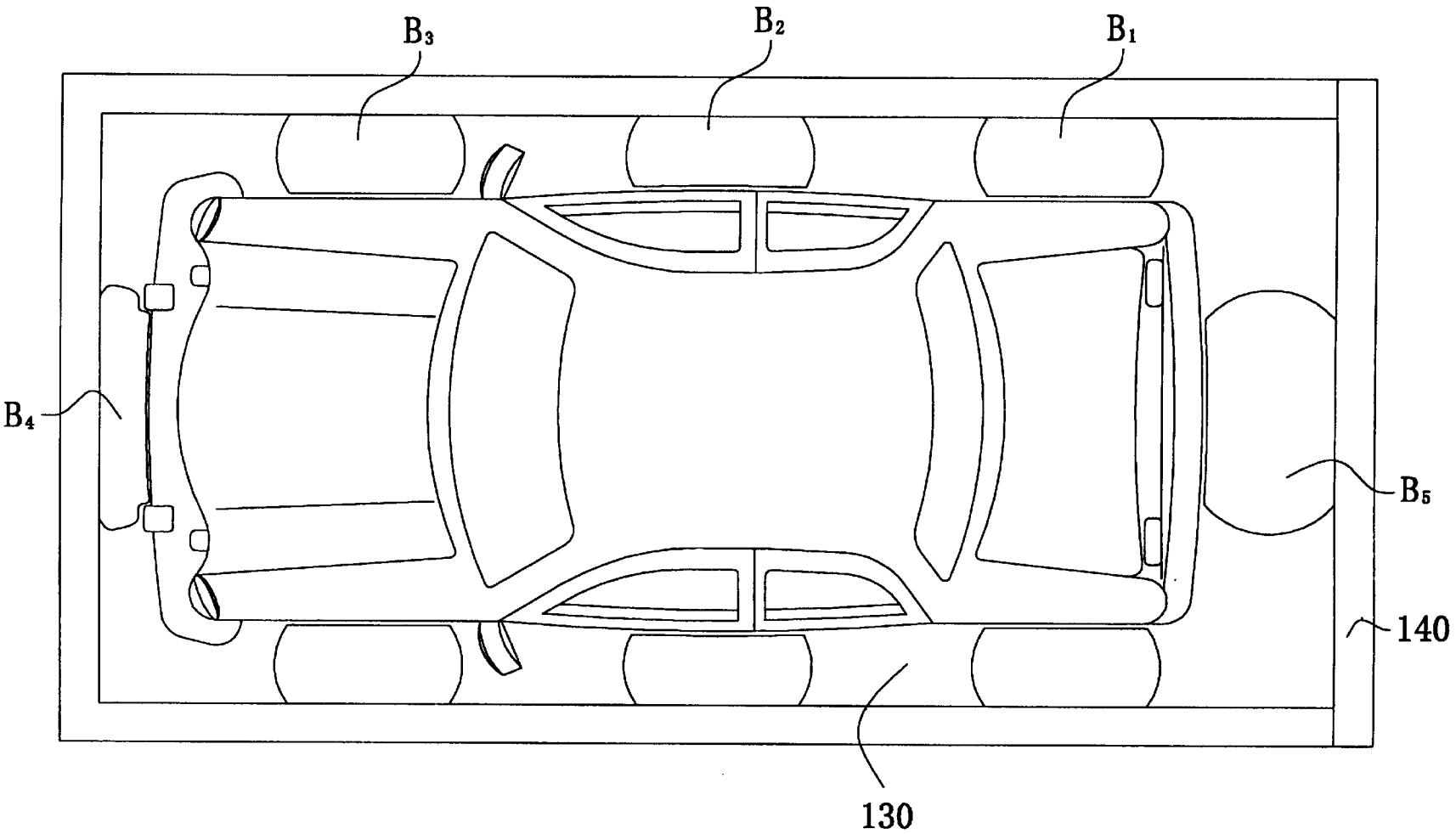
FIG. 14 is a top view of the support mechanism depicted in FIG. 12, with an automotive vehicle being restrained therein.

Another embodiment of a car support mechanism is depicted in FIGS. 12, 13 and 14. The car support mechanism includes a platform 130. The platform 130 includes upright sides 135 on three sides thereof. The sides 135 are formed with a plurality of recesses 136. Within each recess 136 is an inflatable bag, such as the bags $B_1$, $B_2$, $B_3$, $B_4$ and $B_5$. There are additional bags, not shown in FIG. 12, as is explained in greater detail below with regard to FIG. 14. The bags $B_1$, $B_2$, $B_3$, $B_4$ and $B_5$ are sealed bags made of a durable air tight material and may include various plies in order to provide an air tight seal. The outer ply of the bags $B_1$, $B_2$, $B_3$, $B_4$ and $B_5$ is soft so that it is unlikely that the outer surface of the bags $B_1$, $B_2$, $B_3$, $B_4$ and $B_5$ can harm painted surfaces, such as the surfaces of an automobile.

Although not shown in FIG. 12, the bags $B_1$, $B_2$, $B_3$, $B_4$ and $B_5$ are connected to an inflation control system 150, as is depicted in FIG. 13. The inflation control system 150 includes a controller 155 that is connected to a valve/sensor control 156. The valve/sensor control 156 is in turn connected to a compressed air tank 157 that is supplied with compressed air from a compressor 158.

The valve/sensor control 156 includes a plurality of valves, each valve for selectively supplying compressed air to the bags $B_1$, $B_2$, $B_3$ through $B_N$. The bag $B_N$ is not depicted but is rather a representation of all the inflatable bags that may be included in the present invention. Each valve is controlled by the controller 155. Each valve includes a sensor (not shown) for sensing the air pressure in each bags $B_1$, $B_2$, $B_3$ through $B_N$.

As is shown in FIG. 14, the car support mechanism depicted in FIG. 12 includes a total of eight (8) inflatable bags, including bags $B_1$, $B_2$, $B_3$ and $B_5$. Each bag is inflatable to a predetermined pressure for securing an automobile on the platform 130.

The platform 130 includes a gate 140 on which the bag $B_5$ is secured. With the gate 140 in a lowered position, as is depicted in FIG. 12, an automobile may be driven onto the platform 130, as is shown in FIG. 14. Once the automobile is in position on the platform 130, the gate 140 is raised and an operator may manipulate controls on the controller 155 causing the bags, including bags $B_1$, $B_2$, $B_3$ and $B_5$ to inflate. In an inflated condition, the bags engage the sides, front and rear of the automobile securely retaining the automobile on the platform 130.

The sensors (not shown) associated with the valves in the valve/sensor control 156 may be used to monitor the pressure within the bags $B_1$, $B_2$, $B_3$ and $B_N$. The pressure within the bags provides an indication of engagement with the automobile. Therefore, if the bags are inflated to a predetermined air pressure, it can be determined that the automobile is secured on the platform 130. The amusement ride utilizing the platform 130 can safely commence with the automobile safely in position on the platform 130. After completion of the ride, the operator may manipulate controls (not shown) on the controller 155 to release the pressure from the inflatable bags out an exhaust 159 so that the bags may retract into the recesses 136, the gate 140 may drop down and the automobile drive out to the next ride.

As should be apparent from FIG. 14, the doors of the automobile are secured against opening by the inflatable bags in contact with the sides of the automobile, further adding to the safety of the car support mechanism depicted in FIGS. 12, 13 and 14.

Figure 15:
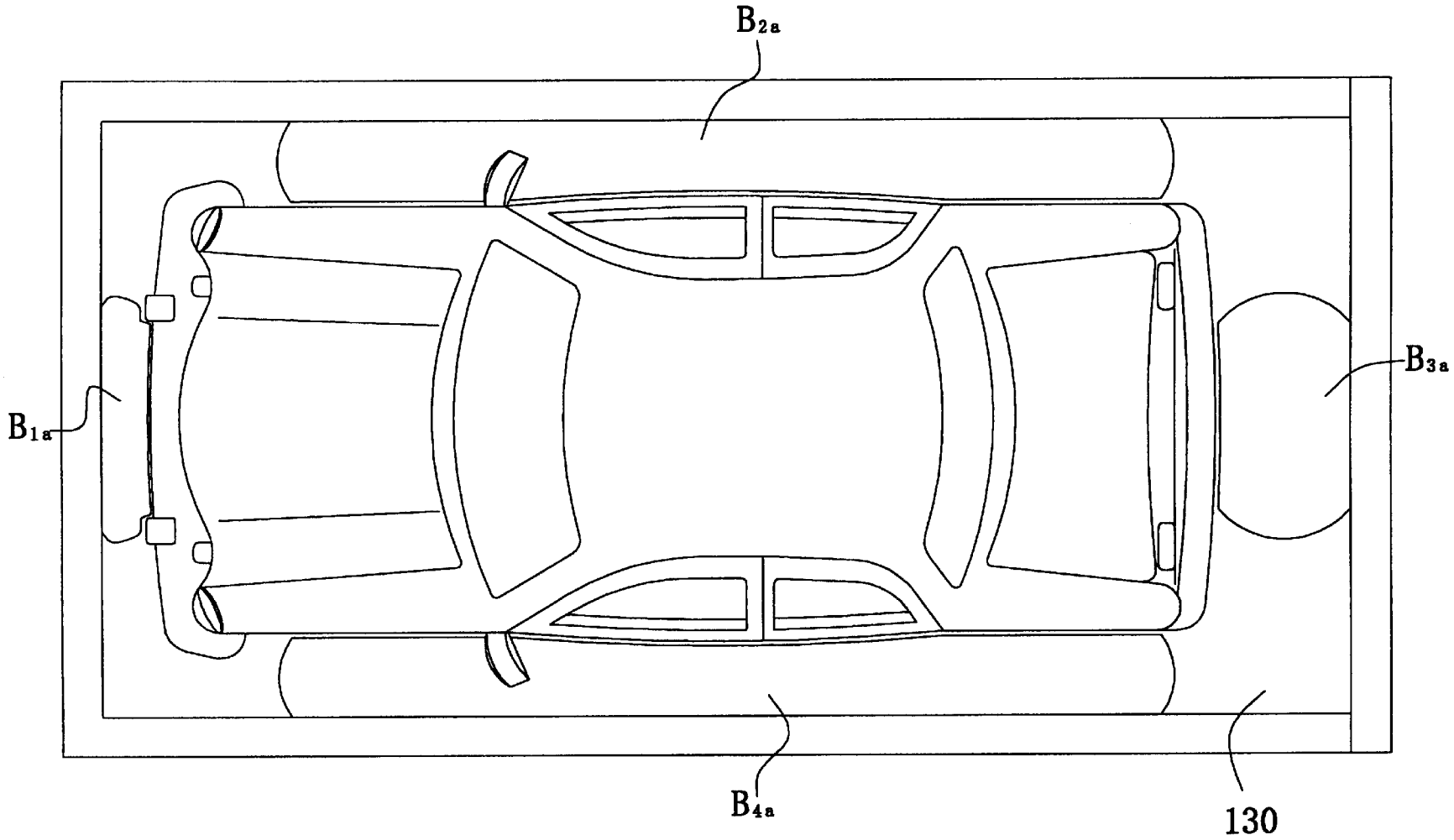
FIG. 15 is a top view of an alternate configuration of the support mechanism depicted in FIG. 12.

It should be understood that the platform 130 may be provided with any of a variety bag configurations. For instance, as is shown in FIG. 15, there may only four (4) bags, bags $B_{1a}$, $B_{2a}$, $B_{3a}$ and $B_{5a}$ on the platform 130. Other combinations of inflatable bags and sizes of inflatable bags are of course possible.

Figure 16:
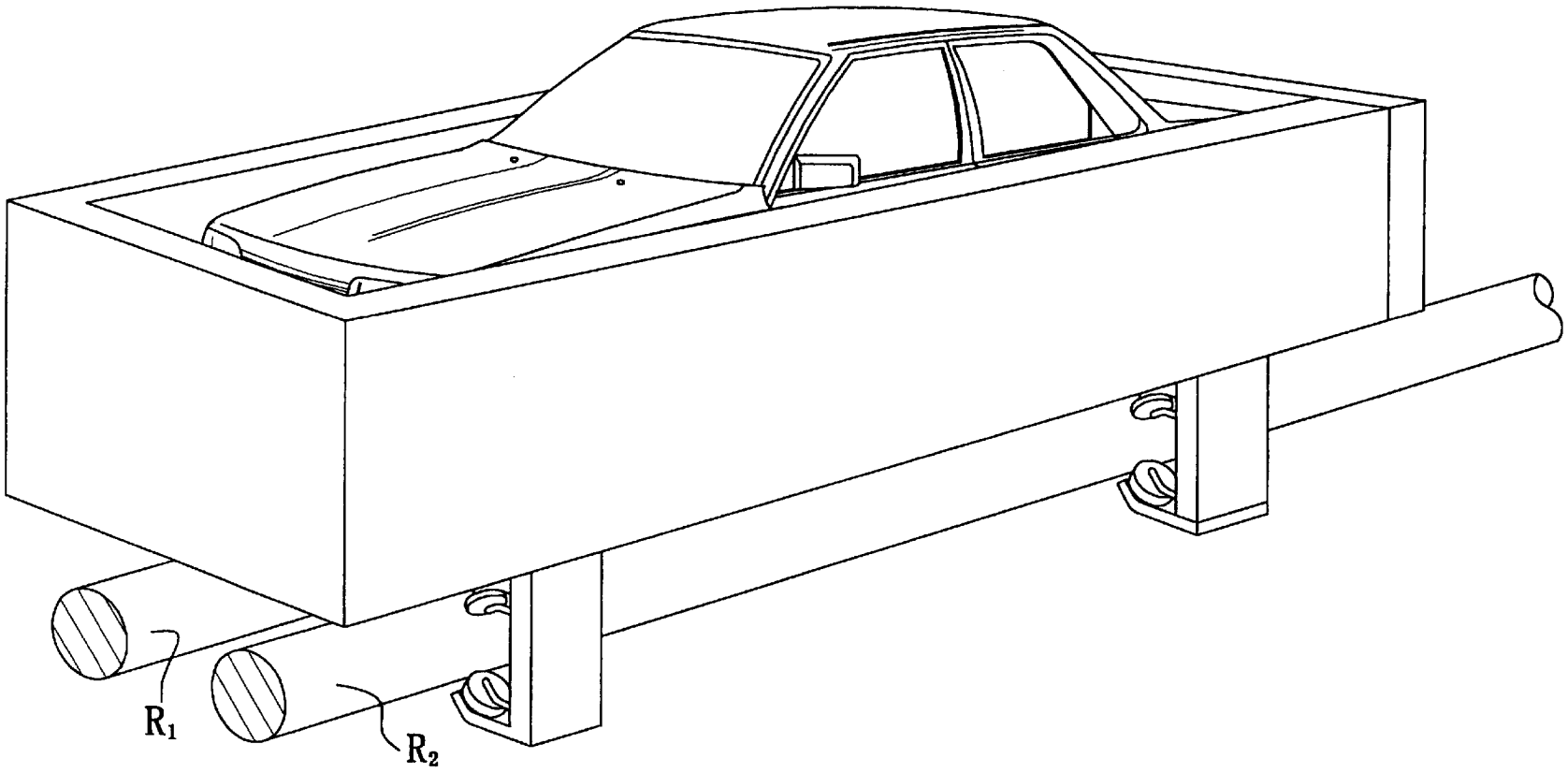
FIG. 16 is a perspective view of the support mechanism depicted in FIG. 12 having track support on an underside thereof.
Figure 17:
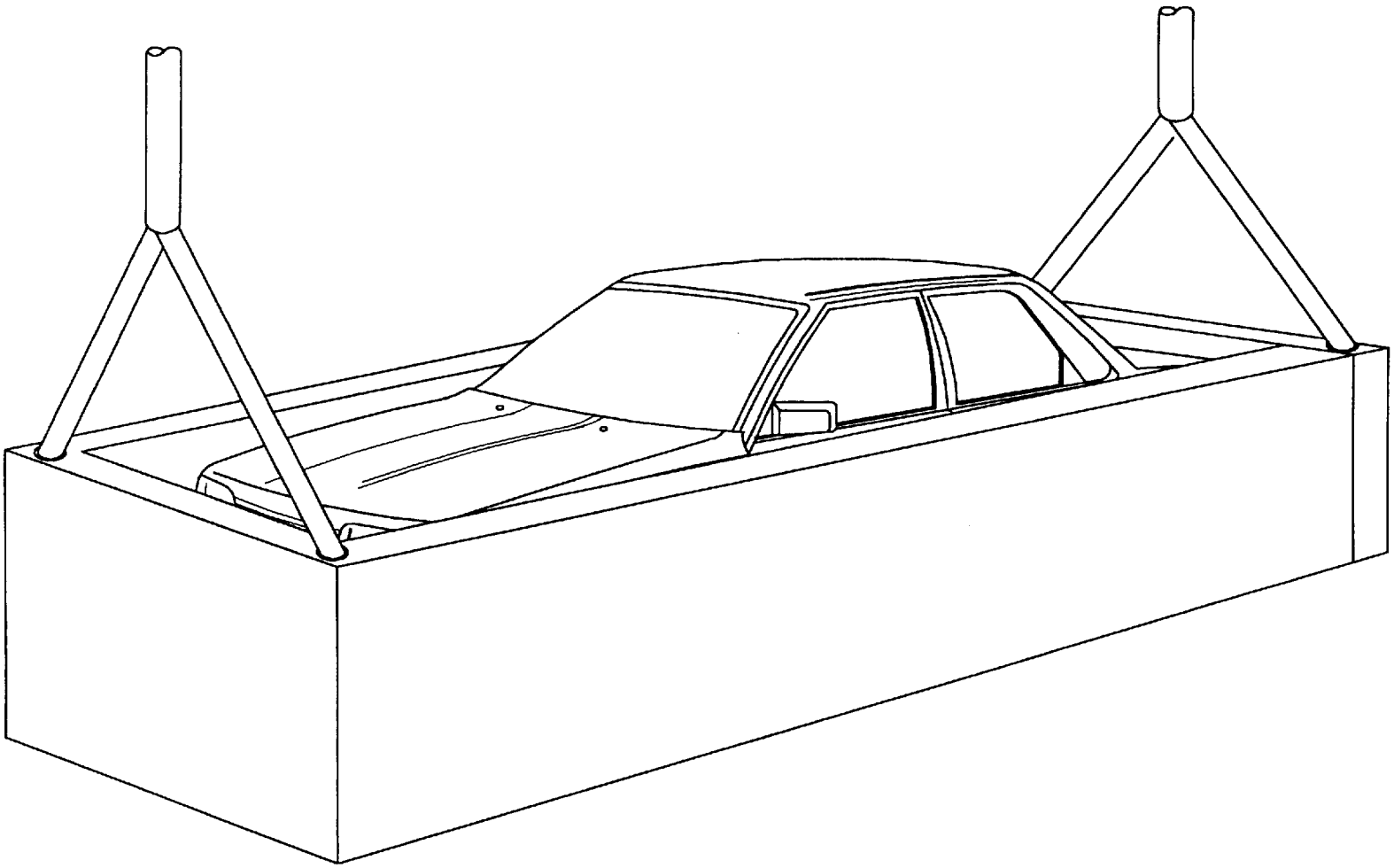
FIG. 17 is a perspective view of the support mechanism depicted in FIG. 12 having support on an upperside thereof.

The platform 130 may be configured in a variety of ways for use on a variety of amusement rides. For instance, as shown in FIG. 16, the platform 130 may be configured for a ride which supports the platform 130 on rails $R_1$ and $R_2$. Or, alternatively, the platform 130 may be supported from above, as depicted in FIG. 17, for use on the swing 12 or the Ferris Wheel 10.

Figure 18:
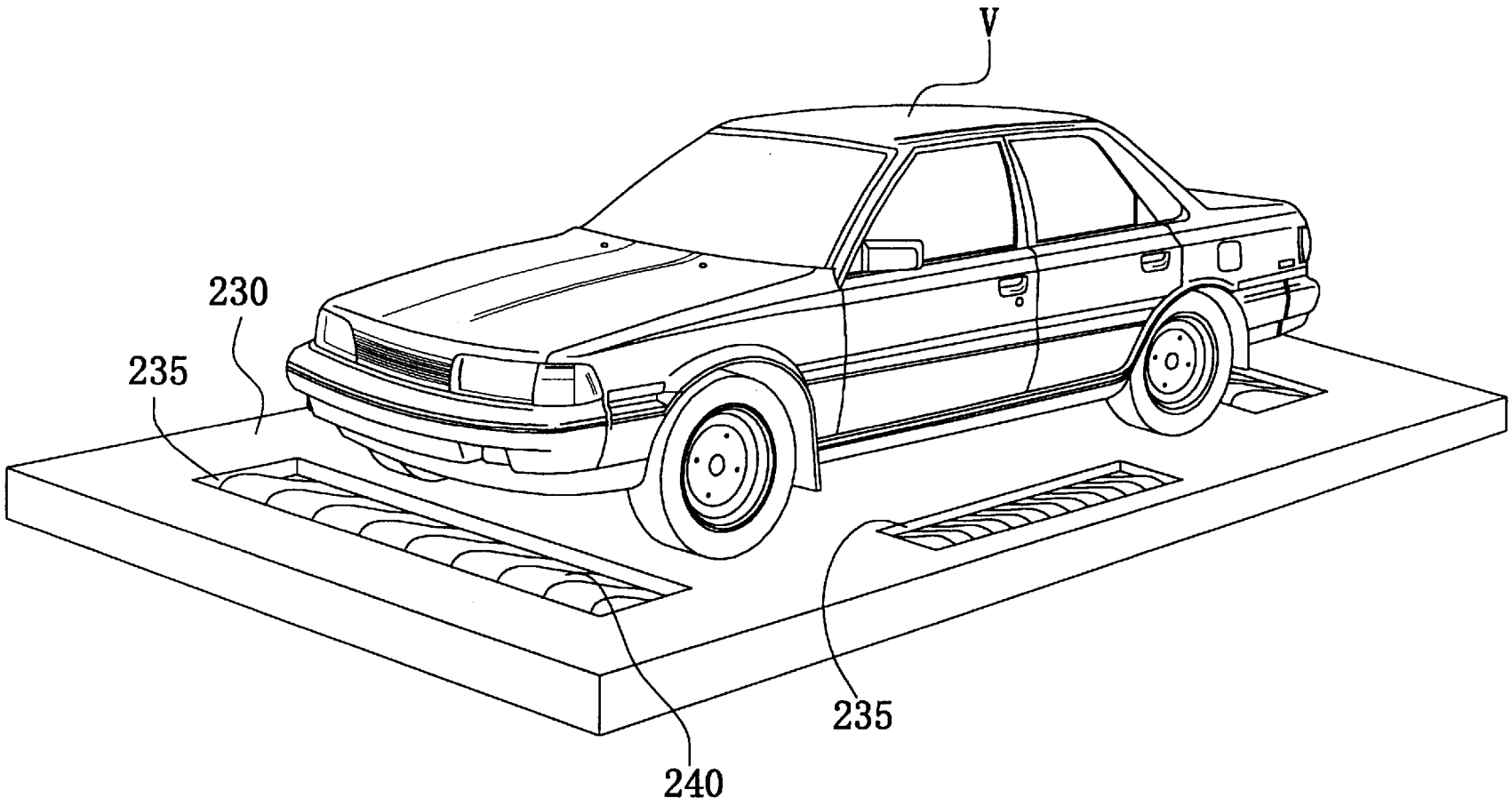
FIG. 18 is a perspective view of still another support mechanism in accordance with the present invention, where the support mechanism includes inflatable bags.
Figure 19:
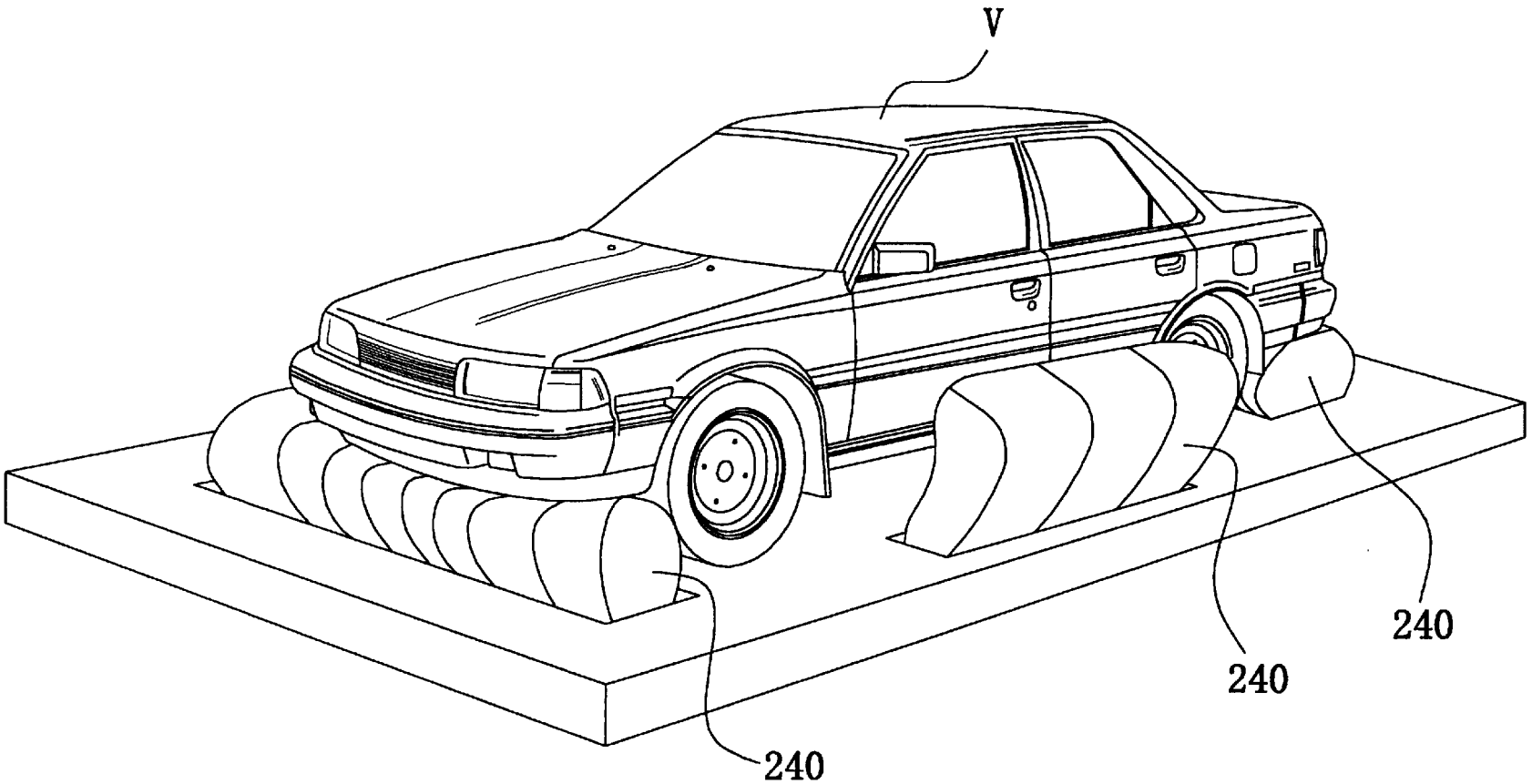
FIG. 19 is a perspective view of the support mechanism depicted in FIG. 18, with the inflatable bags in an inflated state.

Yet another embodiment of the present invention is depicted in FIGS. 18 and 19. A support mechanism having a platform 230 is formed with a plurality of recesses 235. In each recess 235 there is disposed an inflatable bag 240. The inflatable bags 240 are similar to the bags $B_1$, $B_2$, $B_3$ through $B_N$ described above. Although not shown in FIGS. 18 and 19, a control system, such as the control system depicted in FIG. 13 is used to control the inflation condition of the bags 240.

As is shown in FIG. 19, the bags 240 are inflatable for securing an automotive vehicle V to the platform 230. It should be appreciated that the platform 230 depicted in FIGS. 18 and 19 is provided with at least four bags 240, although only three bags 240 are visible. One bag 240 is positioned on each side of the platform 230 corresponding to sides of the automotive vehicle V. One bag 240 is positioned forward from front wheels of the automotive vehicle V and one bag 240 is positioned rearward from rear wheels of the automotive vehicle V.

The positioning of the bags 240 on the platform 230 is such that the wheels of the automotive vehicle V are blocked against rotation with the bags 240 in an inflated state. Further, the bags 240 on either side of the automotive vehicle V are positioned to engage doors of the automotive vehicle V thus preventing the doors from opening with the bags 240 in an inflated state, as shown in FIG. 19.

Thus, the support mechanism depicted in FIGS. 18 and 19 provides a reliable and safe way to restrain a vehicle on the platform 230 in a simple manner.

It should be appreciated that with the bags 240 in an uninflated state, the bags 240 retract into the recesses 235. The bags 240 are may be made of any of a variety of materials making in possible for the car to roll over the bags 240 when entering the platform 230 and leaving the platform 230.

In order to retract into the recesses 235, the bags 240 may be elastic or may have an elastic element or elements formed on an outside surface or within the bags 240.

Figure 20:
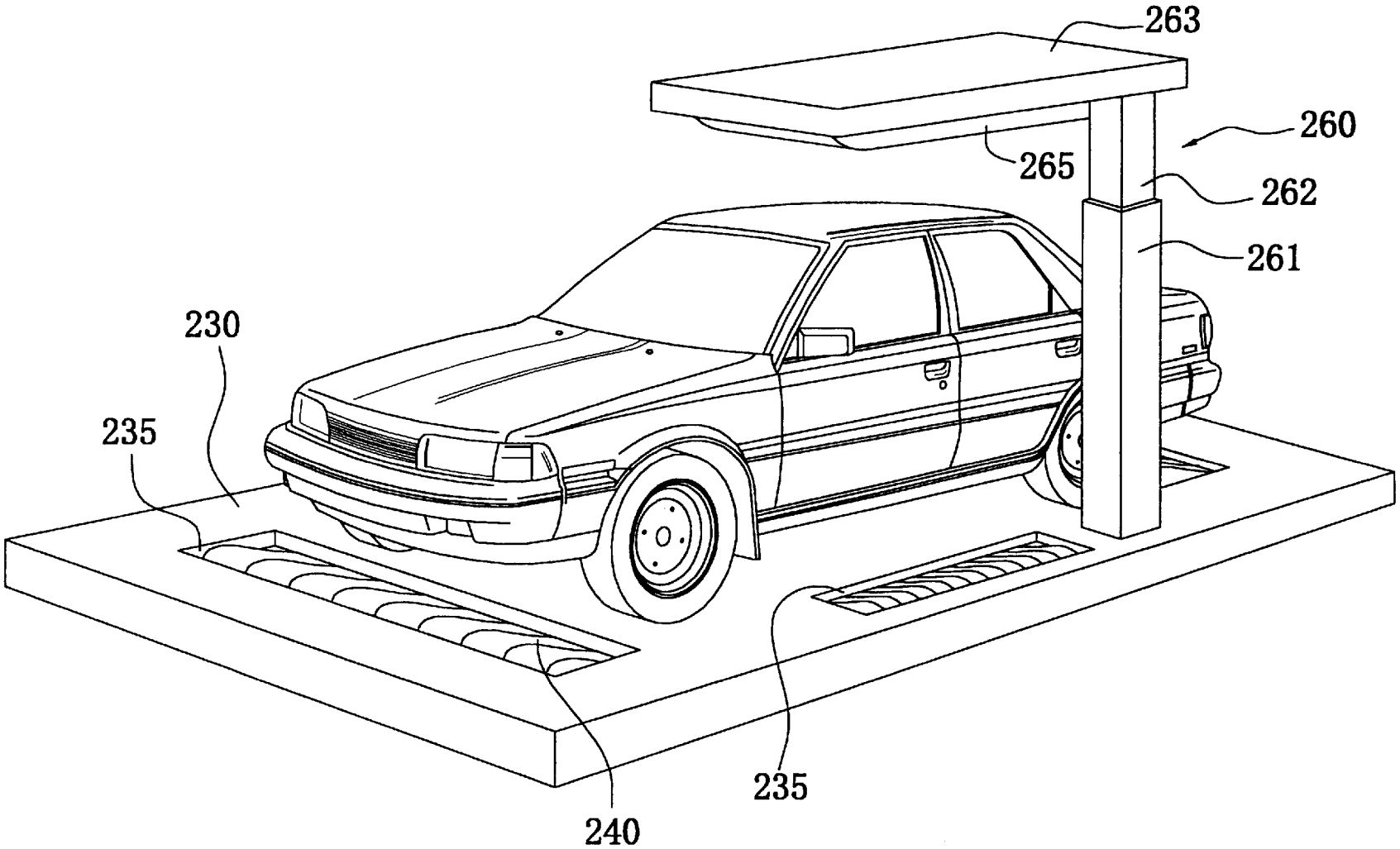
FIG. 20 is a perspective view of a support mechanism similar to that depicted in FIGS. 18 and 19 where the support mechanism further includes an upper support mechanism.

For some amusement park rides, such as the roller coaster, it may be necessary to secure an automotive vehicle from above. In other words, upward movement of the vehicle relative to the platform must be avoided for safety reasons. In such a circumstance, it may be desirable to include a means for holding the vehicle against the surface of the platform of the support mechanism. Such a means is included in the support mechanism depicted in FIG. 20. The support mechanism depicted in FIG. 20 is generally the same as the support mechanism depicted in FIGS. 18 and 19, except that the upper support mechanism 260 is fixed to the platform 230.

The upper support mechanism 260 includes an upright support 261 fixed to the platform 230, a telescoping member 262 that extends upward from the upright support 261 and a support structure 263 which is fixed to the telescoping member 262. On a lower surface of the support structure 263 is a cushion 265. However, the cushion 265 could alternatively be an inflatable bag. The telescoping member 262 may be moved up and down by control means (not shown) such as a crank lever, a hydraulic or pneumatic cylinder or other such device. By moving the telescoping member 262, the cushion 265 maybe brought into engagement with the roof of the automotive vehicle V, thus securing the automotive vehicle V against movement up and down relative to the platform 230.

The upper support mechanism 260 is not limited to the structure as shown. For instance, the upper support mechanism 260 could be used with any of the embodiments of the present invention. Further, the upper support mechanism 260 is not limited to a single upright support member. In some applications it may be desirable to utilize several support members in the upper support mechanism 260. Further, the telescoping member 262 need not be used. Rather the support structure 263 may be directly fixed to the upright support 261 and an inflatable bag may be used instead of a cushion. As well, a sensor may be employed with a control system for automatically sensing the height of the automotive vehicle V and positioning the cushion 265 against the roof of the automotive vehicle V.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An amusement park comprising:

at least one amusement ride for conveying park-goers along a course in the park-goers' own motor vehicles, said amusement ride including a plurality of motor vehicle support mechanisms configured according to dynamics of the ride course to releasably receive a motor vehicle and to secure the motor vehicle in safety throughout the ride course, wherein said motor vehicle support mechanism includes a front and a rear gate configured to secure a motor vehicle received on said motor vehicle support mechanism against moving with respect thereto.

2. The amusement park as set forth in claim 1, wherein said amusement ride is a roller coaster.

3. The amusement park as set forth in claim 1, wherein said amusement ride is an adventure theater.

4. The amusement park as set forth in claim 3, wherein said motor vehicle support mechanism includes a mechanism for restraining retraining movement of the tires of a motor vehicle received on said motor vehicle support mechanism.

5. The amusement park as set forth in claim 1, wherein said amusement ride is a saucer tea cup ride.

6. The amusement park as set forth in claim 1, wherein said amusement ride is a swing ride.

7. The amusement park as set forth in claim 1, wherein said amusement ride is a Ferris wheel.

8. An amusement park comprising:

at least one amusement ride for conveying park-goers along a course in the park-goers' own motor vehicles, said amusement ride including a plurality of motor vehicle support mechanisms configured according to dynamics of the ride course to releasably receive a motor vehicle and to secure the motor vehicle in safety throughout the ride course, wherein each of said motor vehicle support mechanisms includes a platform and front and rear gates supported on said platform, said front and rear gates being configured to secure to said platform a motor vehicle received on said motor vehicle support mechanism against moving with respect to said motor vehicle support mechanism, said platform being further provided with a plurality of rollers selectively brakable against rolling.

9. An amusement park comprising:

at least one amusement ride for conveying park-goers along a course in the park-goers' own motor vehicles, said amusement ride including a plurality of motor vehicle support mechanisms configured according to dynamics of the ride course to releasably receive a motor vehicle and to secure the motor vehicle in safety throughout the ride course, wherein said motor vehicle support mechanism comprises:

a generally flat platform upon which motor vehicle is positionable;

at least two generally upright sides extending from said platform; and at least one inflatable bag fixed to at least one of said upright sides, said inflatable bag being configured for upon inflation abutting against and securing a motor vehicle received on said motor vehicle support mechanism.

10. The amusement park as set forth in claim 9, said motor vehicle support mechanism further comprising a gate mounted to said platform, said gate including a second inflatable bag, said second inflatable bag being configured for upon inflation abutting against and securing a motor vehicle received on said motor vehicle support mechanism.

11. The amusement park as set forth in claim 10, wherein said motor vehicle support mechanism includes means for supporting said platform on an underside thereof for use on said amusement ride, said amusement ride being configured with tracks for receiving said support means.

12. The amusement park as set forth in claim 10, wherein said motor vehicle support mechanism includes means for supporting said platform on an upper side thereof for use on said amusement ride, said amusement ride including means for lifting said platform from the upper side thereof.

13. An amusement park comprising:

at least one amusement ride for conveying park-goers along a course in the park-goers' own motor vehicles, said amusement ride including a plurality of motor vehicle support mechanisms configured according to dynamics of the ride course to releasably receive a motor vehicle and to secure the motor vehicle in safety throughout the ride course, wherein said motor vehicle support mechanism comprises:

a generally flat platform upon which motor vehicle is positionable;

at least one first inflatable bag fixed to said platform, said first inflatable bag being configured for upon inflation abutting against and securing to said platform a motor vehicle received on said motor vehicle support mechanism by preventing wheels of the motor vehicle from rotating.

14. The amusement park as set forth in claim 13, wherein said car support mechanism further comprises:

a second inflatable bag fixed to said platform proximate a rearward side of a motor vehicle received on said motor vehicle support mechanism, wherein said first inflatable bag is positioned to be proximate a forward side of the motor vehicle.

15. The amusement park as set forth in claim 14, wherein said motor vehicle support mechanism further comprises a means for abutting on an upper surface of a motor vehicle received on said motor vehicle support mechanism for restraining upward movement of the motor vehicle.

16. An amusement park comprising:

at least one amusement ride for conveying park-goers along a course in the park-goers' own motor vehicles, said amusement ride including a plurality of motor vehicle support mechanisms configured according to dynamics of the ride course to releasably receive a motor vehicle and to secure the motor vehicle in safety throughout the ride course, wherein each of said motor vehicle support mechanisms further comprises a means for abutting on an upper surface of a motor vehicle received on said motor vehicle support mechanism for restraining upward movement of the motor vehicle with respect to the motor vehicle support mechanism.

17. An amusement park comprising:

at least one amusement ride, said amusement ride including a plurality of a car support mechanisms, each of said car support mechanisms being configured to receive and support an automotive vehicle with passengers inside and said amusement ride is configured to move said plurality of car support mechanisms; and wherein said car support mechanism includes a front and a rear gate configured for securing the automotive vehicle thus preventing movement of the automotive vehicle with respect to said car supporting mechanism.

18. The amusement park as set forth in claim 17, wherein said amusement ride is an adventure theater.

19. The amusement park as set forth in claim 17, wherein said amusement ride is a saucer tea cup ride.

20. The amusement park as set forth in claim 17, wherein said amusement ride is a swing ride.

21. The amusement park as set forth in claim 17, wherein said amusement ride is a Ferris wheel.

22. An amusement park comprising:

at least one amusement ride, said amusement ride including a plurality of a car support mechanisms, wherein each of said car support mechanisms is configured to receive and support an automotive vehicle with passengers inside and said amusement ride is configured to move said plurality of car support mechanisms; and wherein said car support mechanism includes a mechanism for retraining movement of the tires of the automotive vehicle.

23. The amusement park as set forth in claim 22, wherein said amusement ride is an adventure theater.

24. The amusement park as set forth in claim 22, wherein said amusement ride is a saucer tea cup ride.

25. The amusement park as set forth in claim 22, wherein said amusement ride is a swing ride.

26. The amusement park as set forth in claim 22, wherein said amusement ride is a Ferris wheel.

27. An amusement park, comprising:

at least one amusement ride, said amusement ride including a plurality of a car support mechanisms, each of said car support mechanisms being configured to receive and support an automotive vehicle with passengers inside and said amusement ride is configured to move said plurality of car support mechanisms in said amusement ride; and wherein each of said car support mechanisms includes a platform and front and rear gates supported on said platform, said front and rear gates being configured to secure the automotive vehicle to said platform thus preventing movement of the automotive vehicle with respect to the car supporting mechanism, and said platform being further provided with a plurality of rollers which may be selectively braked against rolling movement.

28. The amusement park as set forth in claim 27, wherein said amusement ride is a saucer tea cup ride.

29. The amusement park as set forth in claim 27, wherein said amusement ride is a swing ride.

30. The amusement park as set forth in claim 27, wherein said amusement ride is a Ferris wheel.

31. An amusement park, comprising:

at least one amusement ride, said amusement ride including a plurality of a car support mechanisms, wherein each of said car support mechanisms is configured to receive and support an automotive vehicle with passengers inside and said amusement ride is configured to move said plurality of car support mechanisms;

wherein said car support mechanism comprises:

a generally flat platform upon which an automobile is positionable;

at least two generally upright sides extending from said platform; and at least one inflatable bag being fixed to at least one of said upright sides, upon inflation, said inflatable bag being configured to engage and secure the automotive vehicle on said platform.

32. The amusement park as set forth in claim 31, said car supporting mechanism further comprising a gate mounted to said platform, said gate including a second inflatable bag.

33. The amusement park as set forth in claim 32, wherein said car support mechanism includes means for supporting said platform on an underside thereof for use on said amusement ride, said amusement ride being configured with tracks for receiving said support means.

34. The amusement park as set forth in claim 32, wherein said car support mechanism includes means for supporting said platform on an upperside thereof for use on said amusement ride, said amusement ride including means for lifting said platform from an upper side thereof.

35. The amusement park as set forth in claim 31, wherein said amusement ride is a saucer tea cup ride.

36. The amusement park as set forth in claim 31, wherein said amusement ride is a swing ride.

37. The amusement park as set forth in claim 31, wherein said amusement ride is a Ferris wheel.

38. An amusement park, comprising:

at least one amusement ride, said amusement ride including a plurality of a car support mechanisms, wherein each of said car support mechanisms is configured to receive and support an automotive vehicle with passengers inside and said amusement ride is configured to move said plurality of car support mechanisms;

wherein said car support mechanism comprises:

a generally flat platform upon which an automobile is positionable;

at least one first inflatable bag being fixed to said platform, said first inflatable bag being configured to engage and secure the automotive vehicle on said platform by preventing wheels of the automotive vehicle from rotating.

39. The amusement park as set forth in claim 38, wherein said amusement ride is a saucer tea cup ride.

40. The amusement park as set forth in claim 38, wherein said amusement ride is a swing ride.

41. The amusement park as set forth in claim 38, wherein said amusement ride is a Ferris wheel.

42. An amusement park comprising:

at least one amusement ride for conveying park-goers along a course in the park-goers' own motor vehicles, said amusement ride including a plurality of motor vehicle support mechanisms configured according to dynamics of the ride course to releasably receive a motor vehicle and to secure the motor vehicle in safety throughout the ride course;

wherein each of said car support mechanisms comprises:

a platform; and inflatable bags fitted to said platform to be proximate sides of a motor vehicle received on said motor vehicle support mechanism for securing the motor vehicle in position on said platform.

43. The amusement park as set forth in claim 42, wherein said amusement ride is a saucer tea cup ride.

44. The amusement park as set forth in claim 42, wherein said amusement ride is a swing ride.

45. The amusement park as set forth in claim 42, wherein said amusement ride is a Ferris wheel.

46. An amusement park comprising:

at least one amusement ride, said amusement ride including a plurality of a car support mechanisms, wherein each of said car support mechanisms is configured to receive and support an automotive vehicle with passengers inside and said amusement ride is configured to move said plurality of car support mechanisms;

wherein each of said car support mechanisms further comprises a means for contacting an upper surface of the automotive vehicle for restraining upward movement of the automotive vehicle with respect to the car support mechanism.

47. The amusement park as set forth in claim 46, wherein said amusement ride is a roller coaster.

48. The amusement park as set forth in claim 46, wherein said amusement ride is an adventure theater.

49. The amusement park as set forth in claim 46, wherein said amusement ride is a saucer tea cup ride.

50. The amusement park as set forth in claim 46, wherein said amusement ride is a swing ride.

51. The amusement park as set forth in claim 46, wherein said amusement ride is a Ferris wheel.

* * * * *